US007069920B2

(12) United States Patent
Gamberini et al.

(10) Patent No.: US 7,069,920 B2
(45) Date of Patent: Jul. 4, 2006

(54) AIR SUPPLY UNIT FOR AN INTERNAL COMBUSTION ENGINE

(75) Inventors: Giuseppe Gamberini, Bologna (IT); Alessandro Cavrini, Bologna (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 0 days.

(21) Appl. No.: 10/983,903

(22) Filed: Nov. 9, 2004

(65) Prior Publication Data

US 2005/0103316 A1 May 19, 2005

(30) Foreign Application Priority Data

Nov. 14, 2003 (IT) ..... BO2003A0677

(51) Int. Cl.
*F02B 13/00* (2006.01)

(52) U.S. Cl. ..... 123/580; 123/184.53; 123/336

(58) Field of Classification Search ..... 123/336, 123/442, 184.47, 184.53, 579, 580, 585
See application file for complete search history.

(56) References Cited

U.S. PATENT DOCUMENTS

| | | | |
|---|---|---|---|
| 5,501,192 | A | 3/1996 | Cutler |
| 6,334,430 | B1 | 1/2002 | Itabashi |

FOREIGN PATENT DOCUMENTS

| | | | |
|---|---|---|---|
| EP | 0 455 234 | A1 | 11/1991 |
| EP | 0 501 514 | A1 | 9/1992 |
| EP | 0 905 367 | A2 | 3/1999 |
| EP | 1 293 653 | A1 | 3/2003 |

*Primary Examiner*—Noah P. Kamen
(74) *Attorney, Agent, or Firm*—Berenato, White & Stavish

(57) ABSTRACT

An air supply unit for an internal combustion engine; the air supply unit is provided a number of butterfly valves and a distributor device, the latter being provided, for each butterfly valve, with a distribution duct capable of placing an internal duct of said butterfly valve in communication with a chamber of the distributor device connected to an intake box by means of a first air duct regulated by a solenoid valve; inside the distributor device, each distribution duct is connected to the intake box by means of a corresponding second air duct regulated by a respective bypass screw and is connected to a corresponding regulation duct opening into an air intake, which is accessible from the outside of the distributor device and is normally closed by an associated removable plug.

18 Claims, 4 Drawing Sheets

AIR SUPPLY UNIT FOR AN INTERNAL COMBUSTION ENGINE

The present invention relates to an air supply unit for an internal combustion engine.

BACKGROUND OF THE INVENTION

An internal combustion engine usually has an air supply unit composed of an intake box (also known as an "air box") which is in communication with the external environment by means of a respective air filter and at least one butterfly valve interposed between the intake box and the intake ducts of the cylinders in order to regulate the flow rate of the air supplied to the cylinders themselves.

According to some design philosophies for internal combustion engines, each engine cylinder is provided with a respective butterfly valve; however, this design approach is associated with some disadvantages, in that once the engine is installed in the respective vehicle, it is extremely difficult to gain access to the individual butterfly valves in order to regulate them, both during vehicle assembly and during periodic maintenance of the vehicle. Moreover, providing each cylinder with a respective butterfly valve brings about an obvious increase in the cost and complexity of the air supply unit because of the greater number of components in the air supply unit itself.

EP0501514A1 discloses an intake system for a multi-cylinder type internal combustion engine comprising throttle valves disposed in a plurality of intake passages commonly connected to an air cleaner, and fuel injection valves disposed in the intake passages downstream of the throttle valves in an intake direction. In such intake system, a plurality of funnel-shaped portions are provided in a throttle body having opposite ends directly coupled to an intake manifold and an air cleaner, respectively, and each of the throttle valves is disposed in the throttle body, so that its upstream end in the intake direction is located at least on the corresponding funnel-shaped portion, when the throttle valve is fully opened; the throttle body includes ports provided therein, which are opened into the intake passages between a coupled surface of the throttle body to the intake manifold and the throttle valves, respectively, and which communicate with one another.

SUMMARY OF THE INVENTION

The aim of the present invention is to provide an air supply unit for an internal combustion engine, which unit does not exhibit the above-described disadvantages and, in particular, is simple and economic to implement.

The present invention provides an air supply unit for an internal combustion engine as claimed in the attached claims.

BRIEF DESCRIPTION OF THE DRAWINGS

The present invention will now be described with reference to the attached drawings, which illustrate a non-limiting embodiment of the invention, in which.

DETAILED DESCRIPTION OF THE INVENTION

Figure 1:
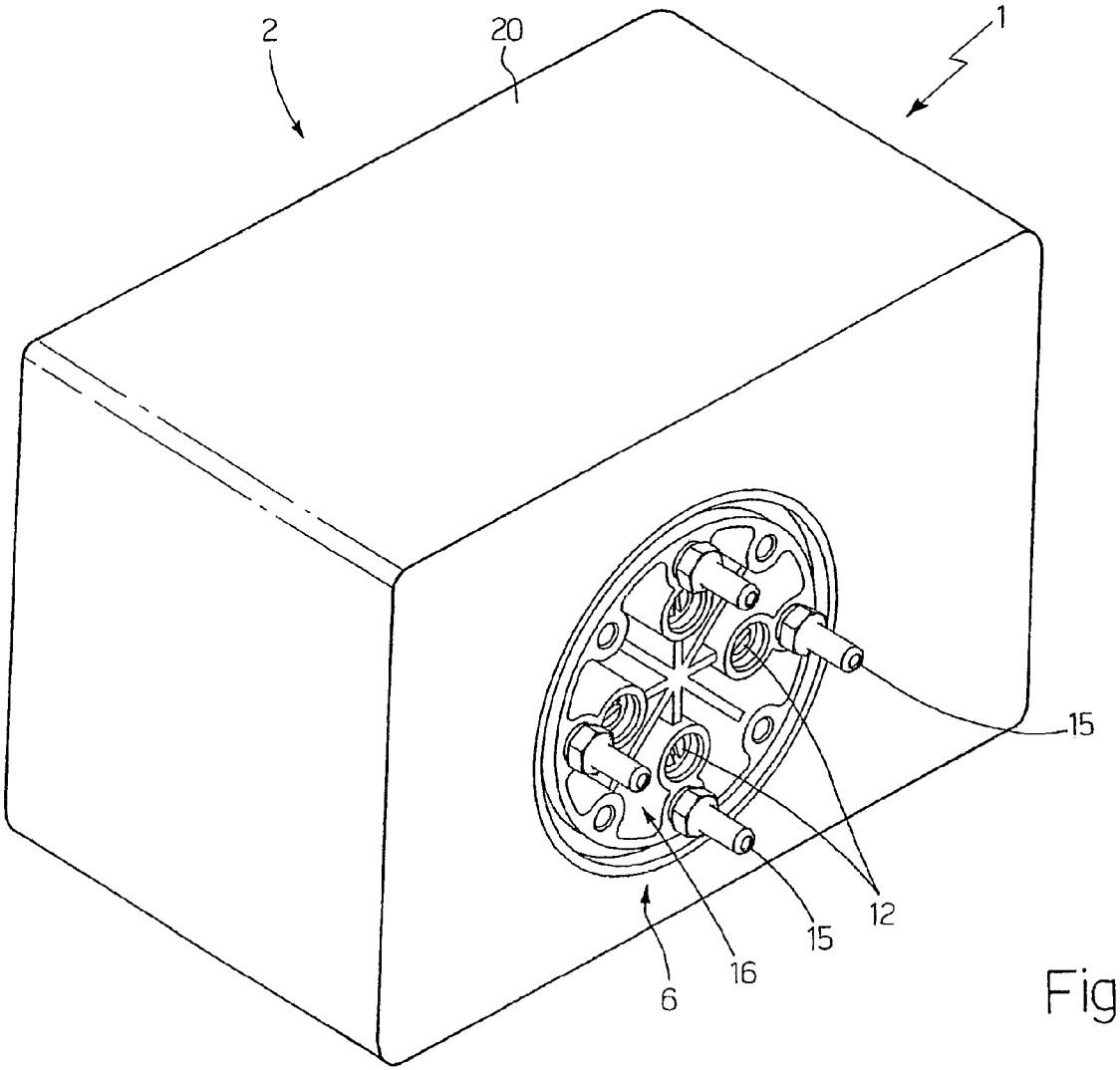
FIG. 1 is a perspective, schematic view of an air supply unit for an internal combustion engine produced in accordance with the present invention.
Figure 2:
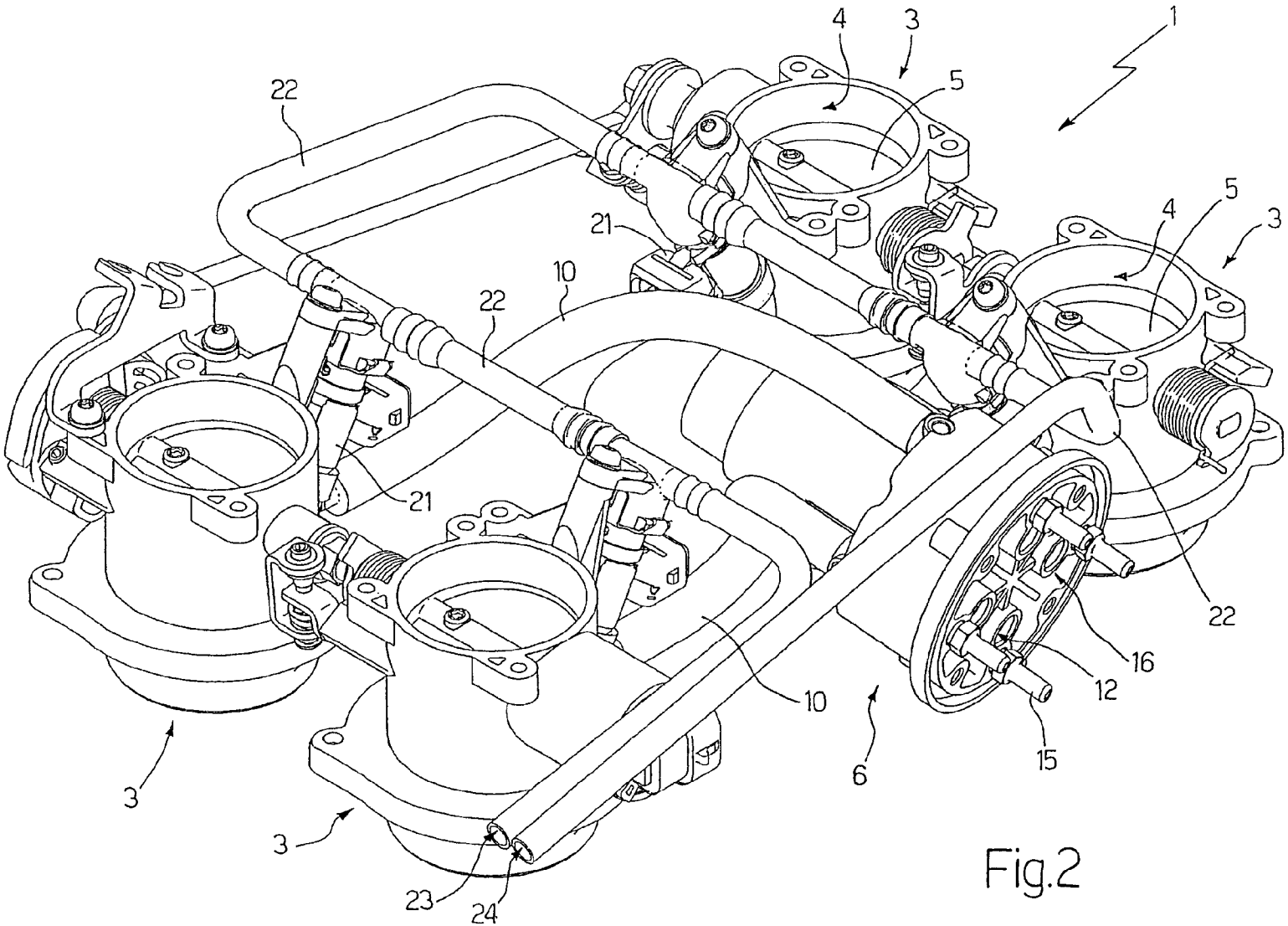
FIG. 2 is a perspective view of the air supply unit in FIG. 1 with some parts removed for clarity.

In FIGS. 1 and 2, the reference number 1 indicates, as a whole, an air supply unit for an internal combustion engine (not shown), said engine being provided with four cylinders (not shown) arranged in a "V" configuration.

The air supply unit 1 comprises an intake box 2 (also known as an "air box") which is in communication with the external environment through an air filter (not shown in detail), and four butterfly valves 3, each of which is connected to a corresponding engine cylinder; each butterfly valve 3 has its own internal duct 4, which is interposed between the intake box 2 and the intake duct of a corresponding cylinder and is regulated by a butterfly disc 5, which oscillates between a closed position and a maximally open position of said internal duct 4.

Figure 4:
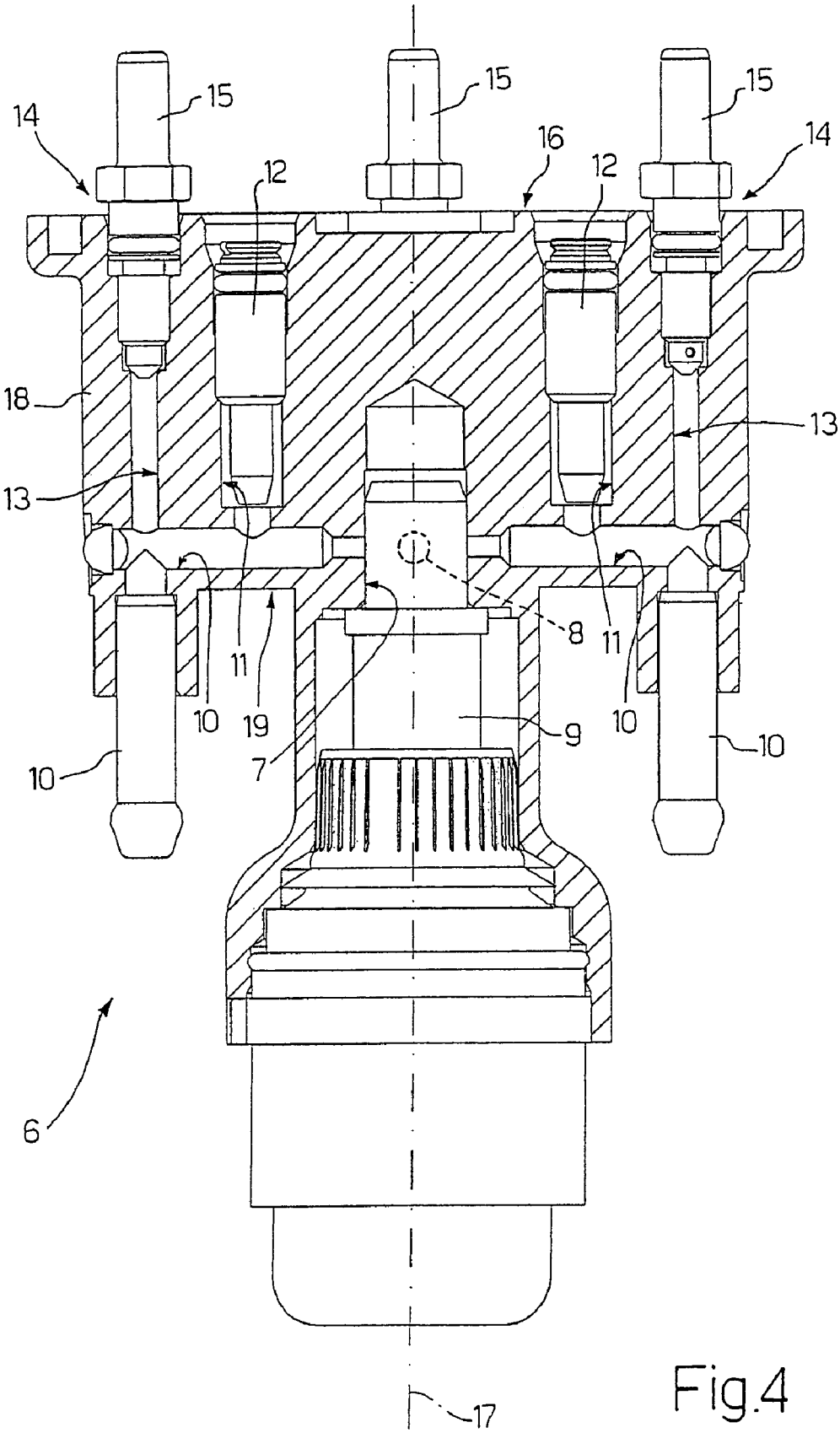
FIG. 4 is a sectional view along the line IV—IV of the distributor device in FIG. 3.

As shown in particular in FIGS. 2 and 4, the air supply unit 1 comprises a distributor device 6, which is provided with a chamber 7 connected to the intake box 2 by means of an air duct 8 (shown in dashed lines in FIG. 4) regulated by a solenoid valve 9; moreover, the distributor device 6 is equipped, for each butterfly valve 3, with a respective distribution duct 10 capable of placing the chamber 7 in communication with the internal duct 4 of the butterfly valve 3. In particular, each distribution duct 10 opens into the internal duct 4 of the respective butterfly valve 3 downstream from the corresponding butterfly disc 5 in such a manner that the quantity of air flowing through the distribution duct 10 is not influenced by the position of the butterfly disc 5.

Inside the distributor device 6, each distribution duct 10 is connected to the intake box 2 by means of a corresponding air duct 11 regulated by a respective bypass screw 12 in order to receive from the intake box 2 a quantity of air that is regulated by the bypass screw 12. Furthermore, inside the distributor device 6, each distribution duct 10 is connected to a corresponding regulation duct 13, which opens into an air intake 14, which is normally closed by an associated removable plug 15 and is arranged on the outside of the intake box 2.

The air intakes 14 and the heads of the bypass screws 12 are fitted on the distributor device 6 so as to be accessible from the same regulation wall 16 of said distributor device 6, the regulation wall 16 being placed on the outside of the intake box 2. In particular, the distributor device 6 has cylindrical symmetry around a central axis 17 thereof, said axis being perpendicular to the regulation wall 16.

Figure 3:
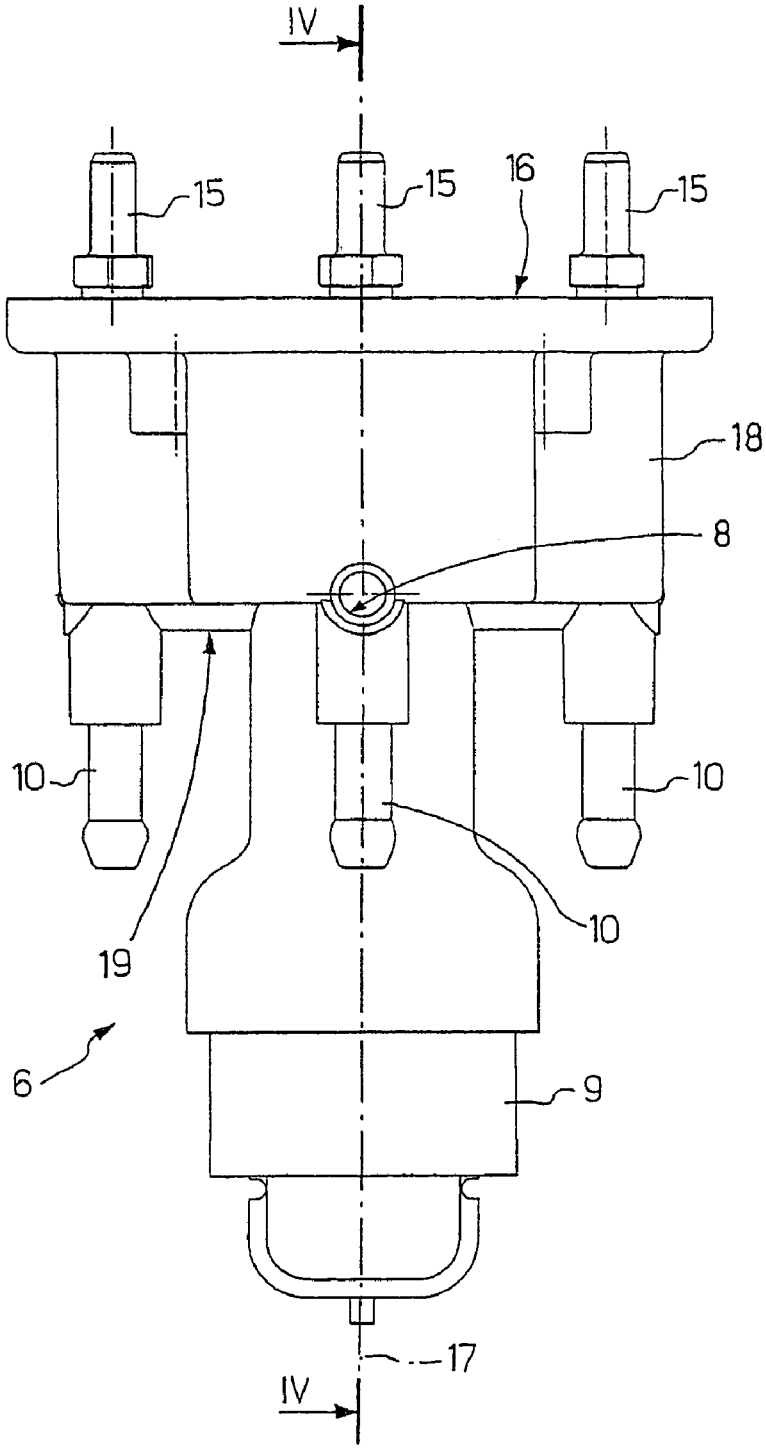
FIG. 3 is a side view of a distributor device of the supply unit in FIG. 1.

As shown in FIG. 3, the solenoid valve 9 is arranged coaxially with the central axis 17 of the distributor device 6 and, on the regulation wall 16, the air intakes 14 and bypass screws 12 are distributed symmetrically around the central axis 17 of the distributor device 6. Furthermore, the distributor device 6 has a cylindrical body 18 that is delimited on one side by the circular regulation wall 16 and on the other side by a circular, crown-shaped wall 19, from which emerge the distribution ducts 10.

As shown in FIG. 1, the intake box 2 comprises a container 20 which is made from a moulded plastic material and accommodates inside it the butterfly valves 3 and the distributor device 6; in particular, the distributor device 6 is fitted in air-tight manner through a side wall of the container 20, such that the regulation wall 16 of the distributor device 6 is placed on the outside of the container 20 and is thus readily accessible from the outside of said container 20.

As shown in FIG. 2, each butterfly valve 3 is associated with a respective fuel injector 21; the fuel injectors 21 receive pressurised fuel from a fuel supply line 22, said line having a fuel delivery end 23 and a fuel return end 24.

During normal engine operation, the distribution ducts 10 are used to supply additional air to the internal ducts 4 of the butterfly valves 3 and thus to the engine cylinders as required by the operating status of the engine (typically at minimum engine speeds or when cold-starting the engine); the flow rate of the additional air supplied to the internal ducts 4 from the distribution ducts 10 is regulated by the solenoid valve 9, which is controlled in a known manner by the engine's electronic central control unit (not shown).

Furthermore, during normal engine operation, through each air duct 11 there constantly flows to the internal duct 4 of the respective butterfly valve 3 a corresponding, specific quantity of air which depends on the position of the associated bypass screw 12. The flow rate of the air flowing through the air ducts 11 is regulated so as to balance the cylinders, so compensating any non-uniformities due to machining tolerances.

During engine development or maintenance, an operator is quickly able to check the vacuum of each cylinder by opening the plugs 15 and connecting a vacuum gauge to the air intakes 14; moreover, an operator can rapidly carry out cylinder balancing operations by screwing the bypass screws 12 in or out so as to vary the flow rate of the air flowing through the air ducts 11 accordingly.

It should be emphasised that an operator can gain access to the regulation wall 16 of the distributor device 6 extremely quickly and straightforwardly, since said regulation wall 16 is placed on the outside of the container 20 of the intake box 2.

It is clear from the above explanation that the above-described air supply unit 1 has various advantages over known supply units 1; in particular, thanks to the presence of the distributor device 6, a single solenoid valve 9 is sufficient for the four butterfly valves 3 with obvious advantages with regard to cost and structural simplicity. Furthermore, any checking, diagnostic or regulation operations on the supply unit 1 are extremely quick and straightforward since all the parts to which the operator has to have access are concentrated on the regulation wall 16 of the distributor device 6, said regulation wall 16 being located in an easily reached position on the outside of the container 20 of the intake box 2.

The invention claimed is:

1. Air supply unit (1) for an internal combustion engine comprising an intake box (2) in communication with an external environment;

a number of butterfly valves (3), each of which has its own internal duct (4) interposed between the intake box (2) and the intake ducts of the engine cylinders; and a distributor device (6), which includes a chamber (7) connected to the intake box (2) by means of a first air duct (8) regulated by a solenoid valve (9) and includes for each butterfly valve (3), a respective distribution duct (10) capable of placing the chamber (7) in communication with the internal duct (4) of said butterfly valve (3);

wherein inside the distributor device (6), each distribution duct (10) is connected to a corresponding regulation duct (13) that opens into an air intake (14), which is accessible from the outside of the distributor device (6) and is closed by an associated removable plug (15).

2. Air supply unit (1) according to claim 1, in which, inside the distributor device (6), each distribution duct (10) is connected to the intake box (2) by means of a corresponding second air duct (11) regulated by a respective bypass screw (12).

3. Air supply unit (1) according to claim 1, in which, inside the distributor device (6), each distribution duct (10) is connected to the intake box (2) by means of a corresponding air duct (11) regulated by a respective bypass screw (12) and each distribution duct (10) is connected to a corresponding regulation duct (13) that opens into an air intake (14), which is normally closed by an associated removable plug (15); the air intakes (14) and the bypass screws (12) being fitted in the distributor device (6) in such a manner as to be accessible from the same regulation wall (16) of said distributor device (6).

4. Air supply unit (1) according to claim 3, in which the intake box (2) comprises a container (20), the interior of which accommodates the butterfly valves (3) and the distributor device (6) in such a manner that the regulation wall (16) of the distributor device (6) is placed on the outside of said container (20).

5. Air supply unit (1) according to claim 3, in which the distributor device (6) has cylindrical symmetry around a central axis (17) thereof, the regulation wall (16) being perpendicular to the central axis (17).

6. Air supply unit (1) according to claim 5, in which the solenoid valve (9) is arranged coaxially with the central axis (17) of the distributor device (6).

7. Air supply unit (1) according to claim 5, in which, on the regulation wall (16), the air intakes (14) and bypass screws (12) are distributed symmetrically around the central axis (17) of the distributor device (6).

8. Air supply unit (1) according to claim 5, in which the distributor device (6) has a cylindrical body (18), which is delimited on one side by the circular regulation wall (16) and on the other side by a circular, crown-shaped wall (19) from which the distribution ducts (10) emerge.

9. Air supply unit (1) according to claim 1, in which each engine cylinder is provided with a respective butterfly valve (3).

10. Air supply unit (1) according to claim 9, in which each butterfly valve (3) is associated with a respective fuel injector (21).

11. Air supply unit (1) according to claim 10, in which a fuel supply line (22) is provided, which supplies the fuel injectors (21) and has a fuel delivery end (23) and a fuel return end (24).

12. Air supply unit (1) according to claim 9, comprising four butterfly valves, each of which is associated with a respective engine cylinder.

13. Air supply unit (1) for an internal combustion engine comprising:

an intake box (2) in communication with an external environment;

a number of butterfly valves (3), each of which has its own internal duct (4) interposed between the intake box (2) and the intake ducts of the engine cylinders; and a distributor device (6), which includes a chamber (7) connected to the intake box (2) by means of a first air duct (8) regulated by a solenoid valve (9) and includes, for each butterfly valve (3), a respective distribution duct (10) capable of placing the chamber (7) in communication with the internal duct (4) of said butterfly valve (3);

wherein inside the distributor device (6), each distribution duct (10) is connected to the intake box (2) by means of a corresponding air duct (11) regulated by a respective bypass screw (12) and each distribution duct (10) is connected to a corresponding regulation duct (13) that opens into an air intake (14), which is normally closed by an associated removable plug (15); the air intakes (14) and the bypass screws (12) being fitted in the distributor device (6) in such a manner as to be accessible from the same regulation wall (16) of said distributor device (6).

14. Air supply unit (1) according to claim 13, in which the intake box (2) comprises a container (20), the interior of which accommodates the butterfly valves (3) and the distributor device (6) in such a manner that the regulation wall (16) of the distributor device (6) is placed on the outside of said container (20).

15. Air supply unit (1) according to claim 13, in which the distributor device (6) has cylindrical symmetry around a central axis (17) thereof, the regulation wall (16) being perpendicular to the central axis (17).

16. Air supply unit (1) according to claim 15, in which the solenoid valve (9) is arranged coaxially with the central axis (17) of the distributor device (6).

17. Air supply unit (1) according to claim 15, in which, on the regulation wall (16), the air intakes (14) and bypass screws (12) are distributed symmetrically around the central axis (17) of the distributor device (6).

18. Air supply unit (1) according to claim 15, in which the distributor device (6) has a cylindrical body (18), which is delimited on one side by the circular regulation wall (16) and on the other side by a circular, crown-shaped wall (19) from which the distribution ducts (10) emerge.

* * * * *